US010589947B2

(12) United States Patent
Haug

(10) Patent No.: US 10,589,947 B2
(45) Date of Patent: Mar. 17, 2020

(54) APPARATUS FOR FRANKING FLAT ITEMS OF MAIL TRANSPORTED INDIVIDUALLY OR FROM A SUPPLIED STACK, SUCH AS ENVELOPES, MAILERS, CARDS, PRINTED PRODUCTS, SLEEVES, LABELS OR THE LIKE, ON A PROCESSING LINE

(71) Applicant: FRAMA AG, Lauperswil (CH)

(72) Inventor: Thomas Peter Haug, Bern (CH)

(73) Assignee: FRAMA AG, Lauperswil (CH)

( * ) Notice: Subject to any disclaimer, the term of this patent is extended or adjusted under 35 U.S.C. 154(b) by 0 days.

(21) Appl. No.: 16/058,201

(22) Filed: Aug. 8, 2018

(65) Prior Publication Data

US 2019/0152732 A1 May 23, 2019

(30) Foreign Application Priority Data

Nov. 22, 2017 (EP) ..... 17405029

(51) Int. Cl.
*B65H 3/06* (2006.01)
*B65H 5/06* (2006.01)
(Continued)

(52) U.S. Cl.
CPC ..... *B65H 3/063* (2013.01); *B65H 3/34* (2013.01); *B65H 3/5238* (2013.01); *B65H 5/062* (2013.01);
(Continued)

(58) Field of Classification Search
CPC ..... B65H 7/04; B65H 3/5238; B65H 1/06; B65H 3/063; B65H 3/0676; B65H 3/46;
(Continued)

(56) References Cited

U.S. PATENT DOCUMENTS 6,102,388 A * 8/2000 Thornhill ..... B65H 3/063 271/10.11
8,448,933 B2 5/2013 Haug
(Continued)

FOREIGN PATENT DOCUMENTS

DE 202016106124 U1 11/2016
EP 1832536 A1 9/2007
EP 2740693 A2 6/2014

*Primary Examiner* — David H Bollinger
(74) *Attorney, Agent, or Firm* — Lucas & Mercanti, LLP; Klaus P. Stoffel

(57) ABSTRACT

An apparatus for franking flat items of mail removed individually or at the underside of a supplied stack and guided in a transport direction at one side edge, includes a separating station formed from a feeder for items of mail separating device, and a downstream processing line of a franking machine, following in a conveying manner in the transport direction, for franking/printing the individual items of mail. The processing line in the transport region between feeder and the separating device of the separating station assigned to the latter includes a plurality of driven transport rollers which form a transport plane for receiving an item of mail or the respective lowest item of mail from a stack, which rollers are mounted in a frame in the transport direction of the items of mail transversely and beside one another and in the same direction and at the same peripheral speed.

8 Claims, 2 Drawing Sheets

(51) Int. Cl.

| | |
|---|---|
| ***B65H 3/52*** | (2006.01) |
| ***B65H 7/04*** | (2006.01) |
| ***G07B 17/00*** | (2006.01) |
| ***B65H 3/34*** | (2006.01) |

(52) U.S. Cl.
CPC ..... *B65H 7/04* (2013.01); *G07B 17/00193* (2013.01); *B65H 2513/10* (2013.01); *B65H 2553/612* (2013.01); *B65H 2701/1916* (2013.01)

(58) Field of Classification Search
CPC ..... B65H 3/5223; B65H 3/66; B65H 3/68; B65H 5/062; B65H 2405/11
See application file for complete search history.

(56) References Cited

U.S. PATENT DOCUMENTS

| | | | | |
|---|---|---|---|---|
| 8,972,046 | B2 | 3/2015 | Mueller et al. | |
| 2007/0222135 | A1* | 9/2007 | Haug ..... | B65H 3/063 271/2 |
| 2016/0214815 | A1* | 7/2016 | Fulleringer ..... | B65H 7/02 |
| 2018/0117633 | A1 | 5/2018 | Ortmann et al. | |

* cited by examiner

APPARATUS FOR FRANKING FLAT ITEMS OF MAIL TRANSPORTED INDIVIDUALLY OR FROM A SUPPLIED STACK, SUCH AS ENVELOPES, MAILERS, CARDS, PRINTED PRODUCTS, SLEEVES, LABELS OR THE LIKE, ON A PROCESSING LINE

The present application claims priority of EP 17 405 029.4, filed Nov. 22, 2017, the priority of this application is hereby claimed and this application is incorporated herein by reference.

BACKGROUND OF THE INVENTION

The invention relates to an apparatus for franking flat items of mail removed individually or at the underside of a supplied stack and guided in a transport direction F at one side edge, such as envelopes, mailers, cards, printed products, sleeves, labels or the like, comprising a separating station formed from a feeder for items of mail that are individually supplied or stacked above one another and a separating device, and a downstream processing line of a franking machine, following in a conveying manner in the transport direction of the items of mail, for franking/printing the separated items of mail.

Sleeves are closable mailing sleeves made of (semi-)card for flat, in particular comparatively thin, products, such as a printed product, a CD or products of similar format.

An apparatus of the above described type is known from EP 1 832 536 A1. This franking machine for processing items of mail, as mentioned at the beginning, has a conveying device formed by conveyor rollers supported above one another, with which items of mail are drawn out of a feeder magazine, arranged behind the same in the conveying direction, at the underside of a stack. For this purpose, the feeder is formed with a front wall for positioning the items of mail, the lower edge of which forms with the conveying plane a removal gap, through which the items of mail are transported individually. For this purpose, a conveyor roller of the conveyor plane that is arranged after the removal gap in the conveying direction F is assigned a guide roller interacting with the first and arranged above the same which is mounted slightly upstream with respect to the axis of rotation of the conveyor roller, downstream of the items of mail. This guide roller is rotatably mounted with a force acting counter to that acting in the same direction as the conveying direction and holds back excess items of mail queuing at the removal gap.

It is important that the items of mail arriving stacked in the feeder but also individual ones are transported in an accurate position in order that no multiple feeds arise, in particular when the items of mail differ in terms of different dimensions and envelope materials, in order to ensure reliable and interruption-free transport.

SUMMARY OF THE INVENTION

The object of the present invention, in an apparatus for a franking machine, was to devise a continuous and synchronized processing mode and transport, primarily of items of mail of different thicknesses from the feeder to the separating device, without adjusting/repositioning the apparatus to the changing thickness or the envelope material of the items of mail to be processed, so that interruption-free processing, user-friendly operation and a high processing throughput and quality can be achieved, in particular for the subsequent franking of the items of mail.

According to the invention, the object is achieved in that the processing line in the transport region between feeder and the separating device assigned to the latter comprises a plurality of driven transport rollers which form a horizontal transport plane for receiving an item of mail or the respective lowest item of mail from a stack, which are driven in the transport direction F of the items of mail transversely and beside one another and in the same direction and at the same or different peripheral speed. Various items of mail up to 12 mm thickness are processed without additional adjustment/readjustment.

Preferably, because of the different material of the envelopes, sleeves, etc., or because of other processing circumstances, the transport roller connected downstream as viewed in the transport direction F can be driven at a higher peripheral speed.

As a result, the aforementioned advantageous objectives can be achieved.

The invention, following a new path, proves to be successful, in particular when processing a stack of items of mail of different thickness and format from a feeder.

A simple embodiment of the transport rollers can be achieved if they are formed from individual rollers or wheels spaced apart laterally which, with a lower inherent weight, permit accurate guidance of the items of mail, which are unstable and/or consist of different materials.

It is advantageous if the transport region between feeder and separating device is formed by at least two transport rollers, of which the transport roller connected downstream in the transport direction F is assigned to the separating device, and the transport roller connected upstream supports the withdrawal of an overlying item of mail out of the feeder.

When withdrawing an individual item of mail or a lowest item of mail from a stack, it proves to be beneficial if a freely rotatable support roller lengthening the transport plane underneath the supplied items of mail is mounted upstream of the first driven transport roller in the transport direction, so that the item of mail gripped directly at the separating device is supported in a flat and extended manner.

It can be to the benefit of the withdrawal operation if the rear ends of the items of mail in the transport direction F are supported so as to be raised above the transport plane on the periphery of a support roller before the plane at the latter running at right angles through the axis of rotation, which effects a certain preliminary separation or pre-separation of the respective lowest item of mail.

For this purpose, the support roller can be mounted in the frame so as to be freely rotatable about an axis arranged to be higher than the transport plane, as viewed transversely with respect to the transport direction F of the items of mail, or driven in a conveying manner.

As viewed in the transport direction F, the support roller can be arranged in the frame such that it can be offset/displaced and fixed, in order to be able to compensate for format deviations of the items of mail.

Moreover, the result is that there is greater friction between the second lowest item of mail in the stack and a sweeping positioning member of the separating device than between the lowest and second lowest item of mail.

It is preparatory for trouble-free withdrawal of the items of mail from a stack or the feeder if the front end of the feeder in the transport direction is formed by a guide/feeder wall which is inclined rearward, and the upstream lower end of which forms with the transport plane a passage or outlet opening extending at least approximately over the width of the transport plane for the removal of the items of mail from the feeder and, as a result of the lower edge angled in the transport direction, gentle guidance arises.

Preferably the guide/feeder wall serving as a stop is designed to be adjustable or vertically adjustable in order to change the passage height or to match the thickness of the items of mail.

Starting up the apparatus and the transport rollers and the separating device can be carried out by a lowest item of mail gripped by the separating device and resting on an actuating element in the transport plane, and triggered via a light barrier.

The invention will be explained below with reference to the cited or citing prior art and the drawings, to which reference will be made with respect to all details not mentioned in more detail in the description, by using an exemplary embodiment.

DETAILED DESCRIPTION OF THE INVENTION

Figure 1:
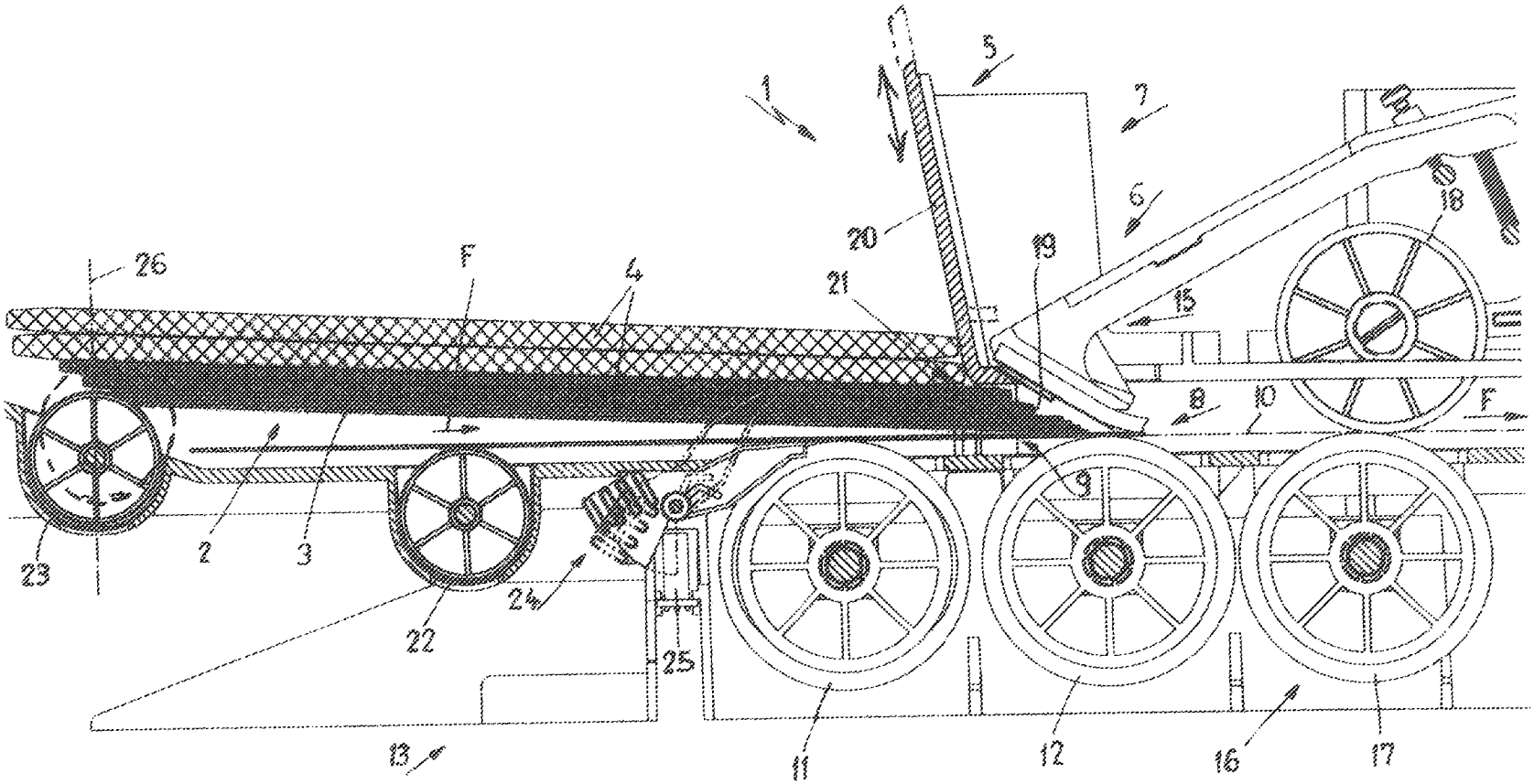
FIG. 1 shows a longitudinal section through a separating station along the processing line of the apparatus for franking flat items of mail.
Figure 2:
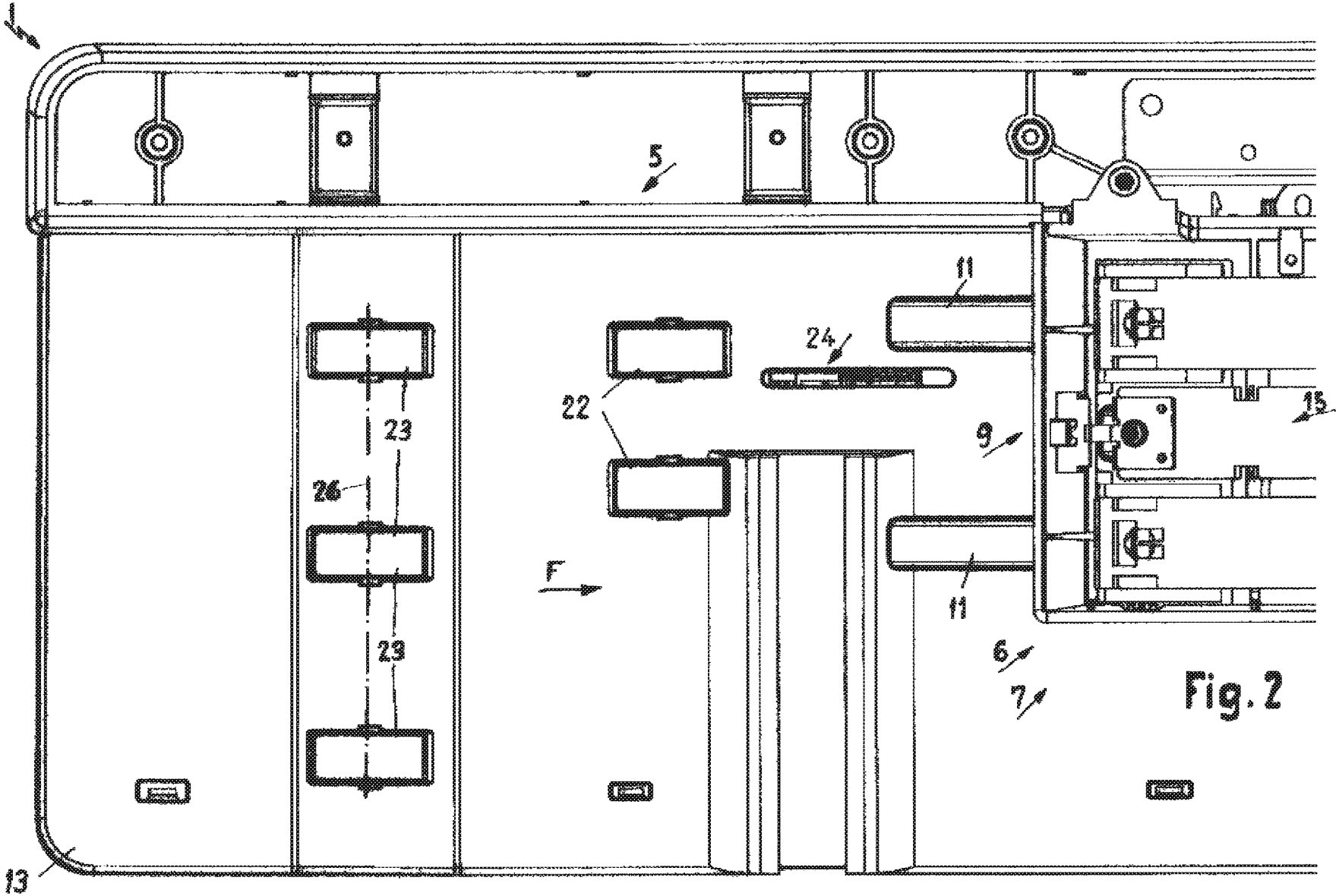
FIG. 2 shows a plan view of the apparatus illustrated in FIG. 1.

FIG. 1 illustrates an apparatus 1 for processing flat items of mail 4 supplied individually or removed at the underside 3 of a supplied stack 2 (as illustrated) from a feeder 5 for franking purposes, such as envelopes, mailers, cards, printed products or journals and catalogues, sleeves for inlaid/inserted products or the like. To this end, the apparatus 1 comprises a separating station 7 formed from a feeder 5 and separating device 6, in which the items of mail 4 arriving are processed individually and are transported onward on a processing line 8 connecting the separating station 7 and a franking station in a conveying manner. In the transport region 9 between feeder 5 and the separating device 6 assigned to the latter, the processing line 8 has at least two transport rollers 11, 12 which form a horizontal transport plane 10 for the separated items of mail 4 and, lying transversely beside one another and at intervals in the transport direction F, preferably have the same diameter and the same peripheral speed and are driven in the same direction. The transport rollers 11, 12 are mounted in a motor-driven manner at their ends in a housing or frame 13 of the apparatus 1 or a franking machine.

The apparatus 1 is followed in the transport direction F by a franking unit connected downstream (not illustrated) for printing, franking or imaging the items of mail 4, which is connected to the present apparatus 1 synchronously and in a conveying manner by the driven transport plane 10 or the transport rollers 11, 12.

FIG. 1 shows the apparatus 1 with items of mail 4 which have been introduced, forming a stack 2 in the feeder 5 and are conspicuous because of different thickness dimensions and format sizes. Of course, by using the apparatus 1 illustrated, identical-format items of mail 4 can also be processed and separated. The items of mail 4 supplied in a stack 2 in feeder 5 are gripped at the transport roller 12 under the action of a positioning member 15 of the separating device 6, and the items of mail 4 overlying/lying above the lowest item of mail 4 are held back and multiple withdrawals from the feeder 5 are prevented. As soon as the lowest item of mail 4 from the stack 2 has been gripped by the transport slier 12 and the positioning member 15, it is transported onward in the transport direction F by the transport rollers 11, 12 in the transport plane 10 and is guided between the pair of conveyor rollers 16 connected downstream of the transport plane 10, of which at least one conveyor miler 17 is driven, whereas an upper, preferably resiliently supported conveyor roller 18 can be driven via a frictional connection with the conveyor roller 17 corresponding to the transport rollers 11, 12 and forming a conveying gap.

In order that the items of mail 4 reach the separating device 6 with the edge 19 leading in the transport direction F in each case aligned in an accurate position and uniformly, the feeder 5 has a front guide/feeder wall 20 inclined preferably counter to the onward movement F, the lower end of which forms with the transport plane 10 a passage/removal opening 21 for the items of mail 4 to be separated. The guide/feeder wall 20 is preferably inclined rearward and extends at least partly over the width of the transport plane 10; it can be adjusted/set in order to change the height of the passage opening.

To adjust the passage opening 21 or the guide/feeder wall 20, lateral guides (not visible) are provided, on which the guide wall 20 is vertically displaceable. The lower end of the guide wall 20 is designed to be angled in the transport direction F, in order as a result to be able to ensure a trouble-free passage of the items of mail 4 at the passage opening 21. For the optimal support or contact of the items of mail 4 in the transport plane 10, the first transport roller 11 is a freely rotatable support roller 22 lengthening the transport plane 10 underneath the items of mail 4 stacked in the feeder 5, mounted in the housing/frame 13 of the apparatus 1.

Furthermore, according to FIG. 1, at the rear end of the feeder 5 in the transport direction F there is arranged a freely rotatable or independently driven support roller 23 supporting the items of mail 4 in the transport direction F at the rear end above the transport plane 10, via the frictional peripheral surface of which the feeding of the items of mail 4 for the separation is assisted. This support roller 23 can be replaced by one with a larger diameter and its position, matched to the transport length of the items of mail 4, can be adjusted/set in the transport direction F in the housing 13 of the apparatus 1, so that the rear ends of the items of mail 4 stacked in the feeder 5, as viewed in the transport direction F, are supported so as to be raised above the transport plane 10 on the periphery of the support roller 23, after the plane 26 of the latter running at right angles through the axis.

An actuating member 24 that can be pivoted about a crosswise axis is mounted before the first transport roller 11 in the transport direction F in the housing/frame 13 of the apparatus 1. This mechanical actuating element 24, illustrated in the operating position of the apparatus 1 and by a broken line in the non-operational position, starts the operation of the apparatus 1 or the franking machine as soon as an item of mail 4 comes to lie on the actuating element 24 or an item of mail 4 rests on a support roller/s 22 and the transport rollers 11 and 12 and in the transport plane 10. The operation of the apparatus 1 is triggered by means of a light barrier 25, which is assigned to the actuating element 24.

I claim:

1. An apparatus for franking flat items of mail removed individually or at an underside of a supplied stack and guided in a transport direction at one side edge, comprising: a frame; a feeder for the items of mail; a separating device; a downstream processing line of a franking machine, following in a conveying manner in a transport direction of the items of mail, for franking/printing the separated items of mail, wherein the processing line in the transport region between the feeder and the separating device includes a plurality of driven transport rollers mounted in the frame to form a horizontal transport plane for receiving an item of mail or a respective lowest item of mail from a stack, the separating device including a motor for driving the transport rollers in the transport direction of the items of mail transversely and beside one another and in a common direction and with a common or different peripheral speed; and a support roller arranged to support rear ends of the stacked items of mail, as viewed in the transport direction, on a periphery of the support roller so that the rear ends are raised above the transport plane along a plane running vertically through an axis of the support roller.

2. The apparatus according to claim 1, wherein the transport region between the feeder and the separating device is formed by at least two of the transport rollers, the transport roller connected downstream being part of the separating device.

3. The apparatus according to claim 2, further comprising, as viewed in the transport direction, a freely rotatable support roller mounted upstream of a first driven transport roller in the transport direction to lengthen the transport plane underneath the supplied items of mail.

4. The apparatus according to claim 1, wherein the support roller is mounted in the frame so as to be freely rotatable about an axis arranged transversely with respect to the transport direction of the items of mail or is driven in a conveying manner.

5. The apparatus according to claim 4, wherein the support roller includes individually spaced rollers.

6. The apparatus according to claim 4, wherein the support roller, as viewed in the transport direction, is arranged in the frame so as to be displaceable/adjustable and fixable.

7. The apparatus according to claim 1, wherein a front end of the feeder in the transport direction of the items of mail is formed by a guide/feeder wall which is inclined rearward and has an upstream lower end that forms with the transport plane a passage opening extending at least partly over a width of the transport plane for removal of the items of mail.

8. The apparatus according to claim 7, wherein the guide/feeder wall is vertically adjustable to change the passage opening.

* * * * *